United States Patent [19]

Alcanzare

[11] 4,041,644

[45] Aug. 16, 1977

[54] REVERSIBLE WINDOW

[76] Inventor: Eduardo V. Alcanzare, No. 16 Kamagong Street, L & S Subdivision, Angeles City, Philippines

[21] Appl. No.: 721,587

[22] Filed: Sept. 8, 1976

[30] Foreign Application Priority Data

Oct. 7, 1975 Philippines ..... 17633

[51] Int. Cl.[2] ..... E05D 15/50

[52] U.S. Cl. ..... 49/163; 49/177

[58] Field of Search ..... 49/149, 162, 163, 164, 49/166, 168, 176, 177, 178, 179, 180, 187, 193, 194, 257, 382, 73; 160/184

[56] References Cited

U.S. PATENT DOCUMENTS

| | | | |
|---|---|---|---|
| 874,164 | 12/1907 | Cibulas | 49/193 |
| 2,406,513 | 8/1946 | Seitzman | 49/162 |

FOREIGN PATENT DOCUMENTS

| | | | |
|---|---|---|---|
| 627,986 | 8/1949 | United Kingdom | 49/163 |

*Primary Examiner*—Kenneth Downey

[57] ABSTRACT

At least two identical sidewise swingable panels are pivotally mounted on a movable frame which is adapted to move horizontally on the main frame.

The swingable panels are adapted to cover the entire space defined by the main frame. This construction permits easy cleaning and also orientation to obtain wind ventilation from left or right of a building.

3 Claims, 4 Drawing Figures

REVERSIBLE WINDOW

BACKGROUND OF THE INVENTION

This invention relates generally to windows and more specifically to a reversible type of window.

Present swingable windows are not reversible, such that the cleaning thereof is difficult. Especially in high-rise buildings, the cleaning of the present types of windows requires the services of professional window cleaners. Due to the high cost of cleaning the windows of multi-storied buildings, the cleaning is done after long intervals of time. Usually, cleaning is done only before the advent of special occasions and the like.

With the proliferation of condominium apartments, the need for windows which can be cleaned easily becomes more imperative, as the cleaning of windows by outsiders would disturb the privacy of the residents.

Moreover, present windows require the installation of the complete unit (except glazing) during construction, with the glazing of the panels performed later also at the job site.

Furthermore, present swingable windows can not be oriented or directed to get wind ventilation on the left or right of the building.

SUMMARY OF THE INVENTION

The principal object of this invention is to provide a type of window with panels which can be reversed so that cleaning of both sides thereof can be done from within the building.

Another object of this invention is to provide a type of window with reversible panels which can be oriented either to the left or to the right to get the maximum wind ventilation.

It is also an object of this invention to provide a type of window with reversible panels, one of the sides of which can be easily covered with a light color so as to reflect light and heat during the summer, and the other side with a dark color so as to serve as a heat accumulator during winter.

A further object is to simplify window installation as only the outer main frame needs to be installed initially with the rest of the parts fitted in later when the building construction is more advanced and cleaner and with the glazing of the panels already factory applied.

Still a further object is to provide a type of window frame which can be used for multi-product advertising.

These objects will be easily and fully appreciated after studying the following detailed discussion of the construction of the reversible window as embodied in this invention and with reference to the accompanying drawings, wherein:

DESCRIPTION OF PREFERRED EMBODIMENTS

Figure 1:
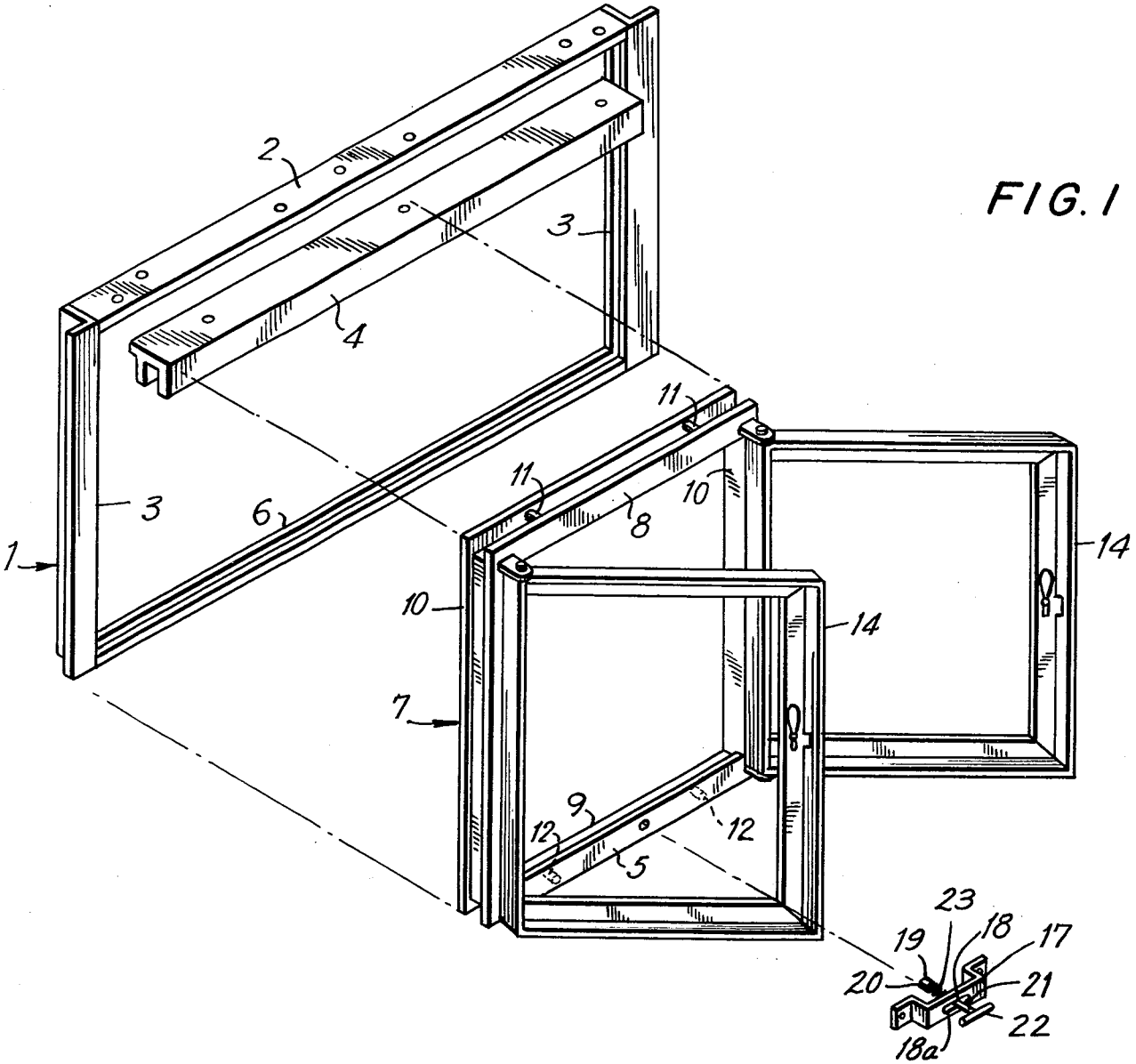
FIG. 1 is an exploded view of the reversible window in accordance with this invention.
Figure 2:
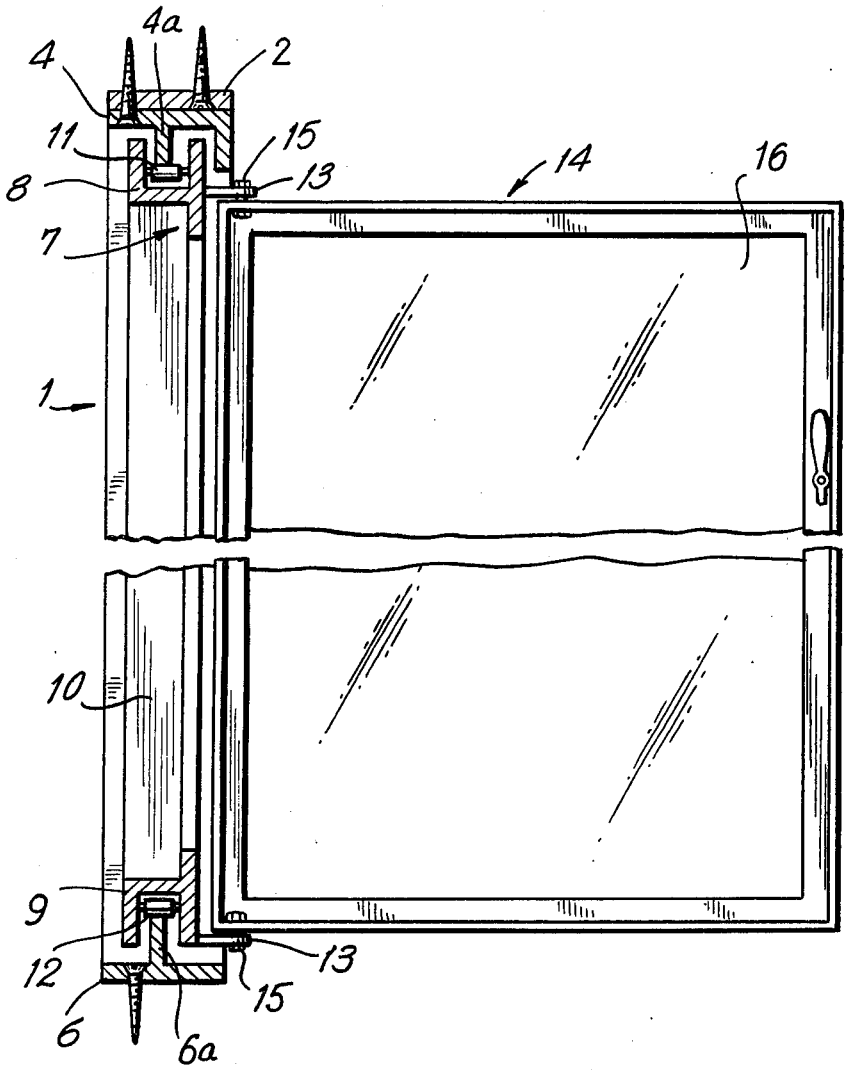
FIG. 2 is a vertical cross-sectional view of the same, taken generally along Line 2—2 of FIG. 3.
Figure 3:
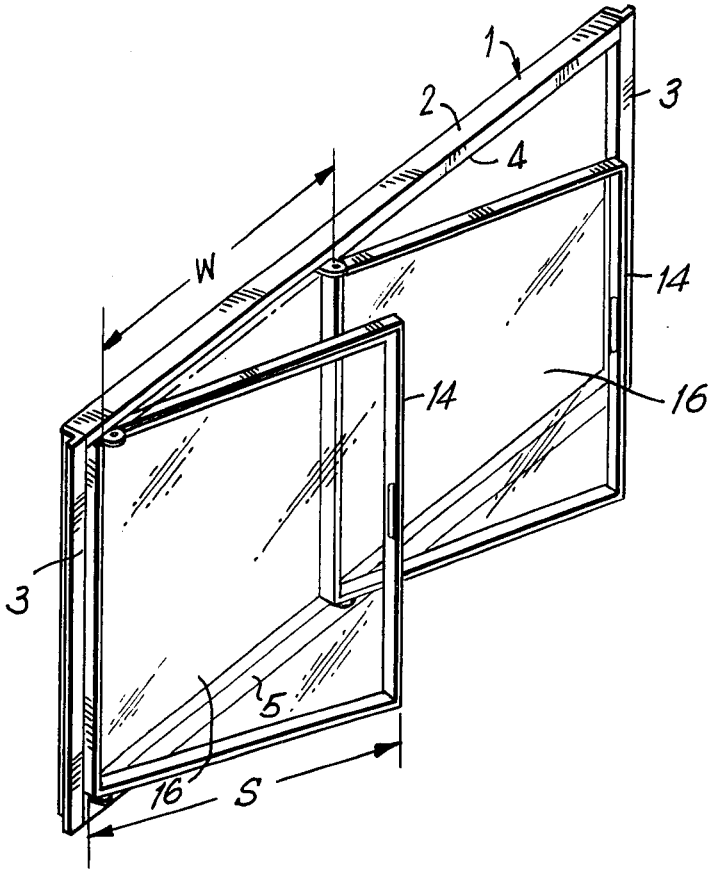
FIG. 3 is a pictorial view of this reversible window with the movable frame located at the left side of the main frame.
Figure 4:
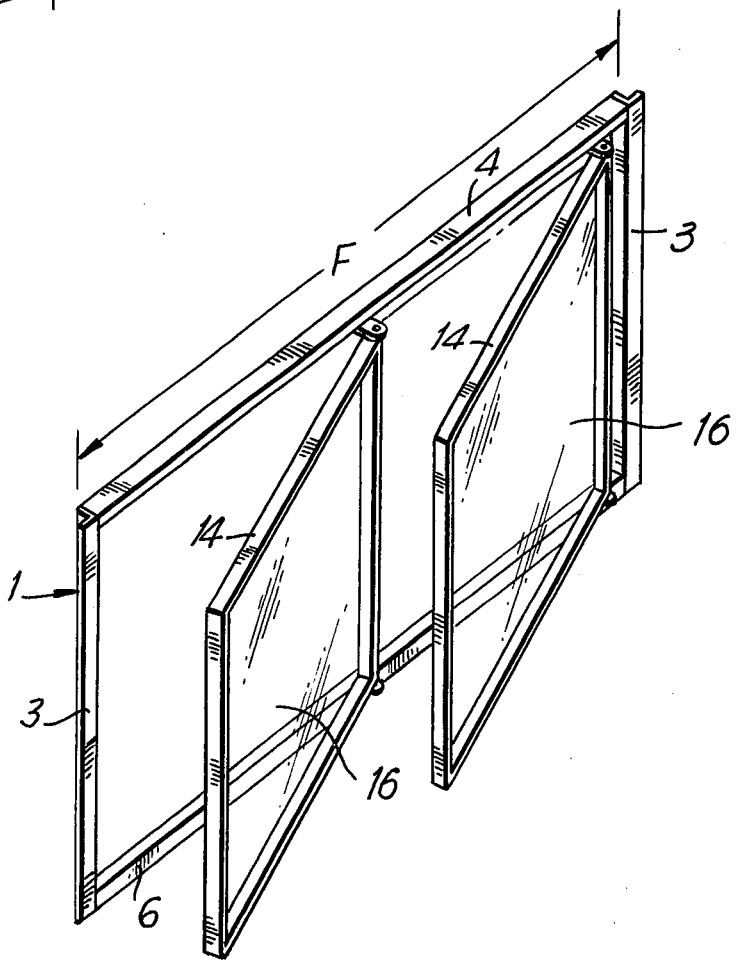
FIG. 4 is another pictorial view of this reversible window with the movable frame located at the right side of the main frame.

With reference now to the drawings, the reversible window, in accordance with this invention, includes a main frame 1 adapted to be secured in the conventional manner to the opening on the building wall provided for the window. A flat bar 2 may be provided on the upper side of the main frame to facilitate the insertion of said main frame 1 into the opening provided on the building wall.

The main frame 1 has vertical members 3, a downwardly facing separable double disposed angular top horizontal frame member 4 with a forwardly disposed channel 5, and an inverted T-shaped horizontal bottom frame member 6. The top horizontal frame member 4 is made separable to facilitate the placement of the movable frame 7.

Adapted to travel inside and along the horizontal top and bottom frame members of the fixed main frame 1 is the movable frame 7 which has guided horizontal top and bottom frame members 8 and 9, and vertical bar side members 10. Disposed rotatively within the said guided horizontal top and bottom frame members 8 and 9 are several spaced rollers 11 and 12, respectively. The rollers 11 abut on the longitudinal side of the inner flange **4*a* of the horizontal top member 8 of the main frame 1 while the rollers 12 abut on the vertical flange 6*a* of the main frame horizontal bottom member 9. On the outer side of the top and bottom members of the movable frame 7 are vertically opposed horizontal lugs 13 to which the swingable panels 14 are pivotally connected in the conventional manner by pins 15. To the swingable panels 14 are attached the glass panels 16**.

As shown in the drawings, the illustrated main frame 1 is to accomodate two identical swingable panels. The width W of the movable frame, in accordance with this invention, is equal to the width F of the main frame minus the width S of one swingable panel. For example, if the width F of the main frame is adapted to receive any number of swingable panels, the width of each panel being S, then the width W of the movable panel is still equal to F−S or $W=F-S$. The reversible window then in accordance with this invention could have any desired number of swingable panels.

To secure the movable frame 7 to the main frame 1, there is provided at least one locking device which consists of a bracket 17 adapted to be attached to the bottom horizontal member 9 of the movable frame 7. The bracket 17 has hole 18 with a diametrical alit **18*a* of the outwardly offset central flange thereof through which a spring-biased bolt 19 is inserted. Said bolt has a circular flange 10 on inner portion thereof which is urged by the spring, a transverse pin 21 and a handle 22**. Corresponding holes are provided on the movable frame and main frame for the spring-biased bolt.

For securing the swingable panels 14, conventional locking devices are provided on the unhinged vertical members thereof, and corresponding slots are provided on the adjacent vertical members of the adjoining swingable panel.

Various modifications may be made on the embodiments which are shown for illustration only, without departing from the essence of the invention as defined in the appended claims.

I claim:

1. A reversible window comprising a main frame, a movable frame disposed on said main frame and adapted to travel horizontally therein, and at least two identical sidewise swingable panels pivotally mounted on said movable frame, said swingable panels adapted to cover the entire space defined by the main frame.

2. The reversible window of claim 1 wherein the width of the movable frame is equal to the width of the main frame minus the width of only one swingable panel, irrespective of the number of swingable panels.

3. The reversible window of claim 1, including means for locking said movable frame to said main frame.

* * * * *